US010827784B2

(12) United States Patent
Pan

(10) Patent No.: US 10,827,784 B2
(45) Date of Patent: Nov. 10, 2020

(54) BRASSIERE FOR NURSING WOMEN

(71) Applicant: Silin Pan, Shenzhen (CN)

(72) Inventor: Silin Pan, Shenzhen (CN)

( * ) Notice: Subject to any disclaimer, the term of this patent is extended or adjusted under 35 U.S.C. 154(b) by 126 days.

(21) Appl. No.: 15/992,289

(22) Filed: May 30, 2018

(65) Prior Publication Data

US 2019/0364981 A1 Dec. 5, 2019

(51) Int. Cl.
*A41C 3/04* (2006.01)
*A41F 15/00* (2006.01)

(52) U.S. Cl.
CPC ..... *A41C 3/04* (2013.01); *A41F 15/002* (2013.01)

(58) Field of Classification Search
CPC ..... A41C 3/04; A41C 15/002; A41D 1/215
USPC ..... 450/36, 70
See application file for complete search history.

(56) References Cited

U.S. PATENT DOCUMENTS 5,897,422 A * 4/1999 McGee ..... A41C 3/00 2/73
6,282,719 B1 * 9/2001 Vera ..... A41D 1/215 2/78.1
7,909,675 B1 * 3/2011 Rainey ..... A41C 3/148 450/59
8,758,082 B1 * 6/2014 Woods ..... A41C 3/04 450/1
2005/0028243 A1 * 2/2005 Polzin ..... A41C 3/04 2/104
2011/0092134 A1 * 4/2011 Alva ..... A41C 3/04 450/36
2015/0143605 A1 * 5/2015 Cobb ..... A41C 3/04 2/104
2016/0007659 A1 * 1/2016 Blacker ..... A41C 3/04 2/104

* cited by examiner

*Primary Examiner* — Timothy K Trieu
(74) *Attorney, Agent, or Firm* — Law Offices of Steven W. Weinrieb

(57) ABSTRACT

A brassiere to assist in pumping breast milk includes an inner layer and an outer layer. The inner layer defines an opening at a central portion and defines an inner edge around the opening. The outer layer covers the opening in a non-stretched state, and defines two lateral edges on opposite sides. Each outer layer defines a nook. The brassiere is configured to receive a funnel within the nook and the opening in a stretched state to allow the funnel to be inserted under the inner layer and within the nook and the opening, such that the funnel is supported against a nipple by the lateral edge and the inner edge for hands free pumping.

8 Claims, 5 Drawing Sheets

BRASSIERE FOR NURSING WOMEN

FIELD OF THE INVENTION

The present disclosure relates generally to a brassiere for a nursing woman. More particularly, this disclosure relates to a brassiere configured to accommodate a woman's use of a breast pump, nursing of an infant by the woman, or both.

BACKGROUND OF THE INVENTION

Many women are finding ways to provide their infants with breast milk even if the mothers are not physically present during the delivery of the milk to the infants. A woman will express milk using a manual or electric breast pump device that has a funnel. The funnel is placed over the nipple of the breast, and suction is applied by the breast pump to encourage the expression of milk from the nipple. A traditional electronic breast pump includes the funnel, a motor to generate the suction for the expression of milk, and a reservoir connected to the funnel to receive the expressed milk. Because of the duration and frequency required for breast milk expression, a woman may express both breasts simultaneously to increase efficiency. This process is often uncomfortable and time consuming. Further, without additional support, the funnel of a traditional breast pump will often not remain over the nipple on the breast.

Therefore, use of the pump usually does not allow the nursing woman to perform other activities simultaneously.

SUMMARY OF THE INVENTION

The technical problem to be solved by the present invention is to provide a brassiere a nursing woman, and more particularly to a brassiere configured to accommodate a nursing woman's use of a breast pump.

In order to solve the above technical problem, one embodiment of the invention provides the following technical solution:

One embodiment of the invention provides a brassiere to assist in pumping breast milk. The brassiere includes an inner layer and an outer layer. The inner layer defines an opening at a central portion and defines an inner edge around the opening. The outer layer covers the opening in a non-stretched state, and defines two lateral edges on opposite sides. Each outer layer defines a nook. The brassiere is configured to receive a funnel within the nook and the opening in a stretched state to allow the funnel to be inserted under the inner layer and within the nook and the opening, such that the funnel is supported against a nipple by the lateral edge and the inner edge for hands free pumping.

As a preferred technical solution of the embodiment of the invention, the inner layer and the outer layer are made of stretchable material.

As a preferred technical solution of the embodiment of the invention, at least one of the inner edge of the inner layer and the lateral edge of the outer layer is stretchable.

As a preferred technical solution of the embodiment of the invention, the inner layer is configured to cover the nipple and a majority of the breast in the non-stretched state.

As a preferred technical solution of the embodiment of the invention, the inner edges of the inner layer is stretched in the stretched state.

As a preferred technical solution of the embodiment of the invention, the outer layer is configured to cover the nipple and a majority of the breast in the non-stretched state.

As a preferred technical solution of the embodiment of the invention, each lateral edge of the outer layer is stretched in the stretched state.

As a preferred technical solution of the embodiment of the invention, the inner edge of the inner layer is substantially circular.

As a preferred technical solution of the embodiment of the invention, each lateral edge is substantially arcuate recessing toward the opening of the inner layer.

As a preferred technical solution of the embodiment of the invention, the brassiere further comprises a shoulder strap and a releasable clasp located on the shoulder strap, the releasable clasp is attached to a joint portion of the outer layer and the inner portion, and is configured to disconnect the outer layer and the inner layer from the shoulder strap to uncover the breast and the nipple for direct nursing.

Other embodiment of the invention provides a brassiere to assist in pumping breast milk. The brassiere includes an inner layer and an outer layer. The inner layer covers two nipples and majorities of two breasts, and defines an opening at a middle position of two beasts in a non-stretched state. The outer layer is partially overlapping the inner layer, and defines two nooks at two opposite sides of the opening in the non-stretched state. The brassiere is configured to receive a funnel within the nook and the opening in a stretched state to allow the funnel to be inserted under the inner layer, such that the funnel is supported against a nipple by the lateral edge and the inner edge for hands free pumping.

As a preferred technical solution of the embodiment of the invention, the inner layer and the outer layer are made of stretchable material.

As a preferred technical solution of the embodiment of the invention, an inner edge of the inner layer and a lateral edge of the outer layer is stretchable.

As a preferred technical solution of the embodiment of the invention, the inner edge of the inner layer is stretched in the stretched state.

As a preferred technical solution of the embodiment of the invention, the outer layer is configured to cover the two nipples and the majorities of the two breasts in the non-stretched state.

As a preferred technical solution of the embodiment of the invention, a lateral edge of each nook is stretched in the stretched state.

As a preferred technical solution of the embodiment of the invention, the opening of the inner layer is substantially circular.

As a preferred technical solution of the embodiment of the invention, each nook is substantially arcuate recessing toward the opening of the inner layer.

As a preferred technical solution of the embodiment of the invention, the brassiere further comprises a shoulder strap and a releasable clasp located on the shoulder strap, the releasable clasp is attached to a joint portion of the outer layer and the inner layer, and is configured to disconnect the outer layer and the inner layer from the shoulder strap to uncover the breast and the nipple for direct nursing.

BRIEF DESCRIPTION OF THE DRAWINGS

The drawings are used for providing further understanding of the present invention, constitute a part of the description and are used for explaining the present invention together with the embodiment of the present invention, but do not constitute a limitation to the present invention. In the drawings.

DETAILED DESCRIPTION OF THE EMBODIMENTS

Figure 1:
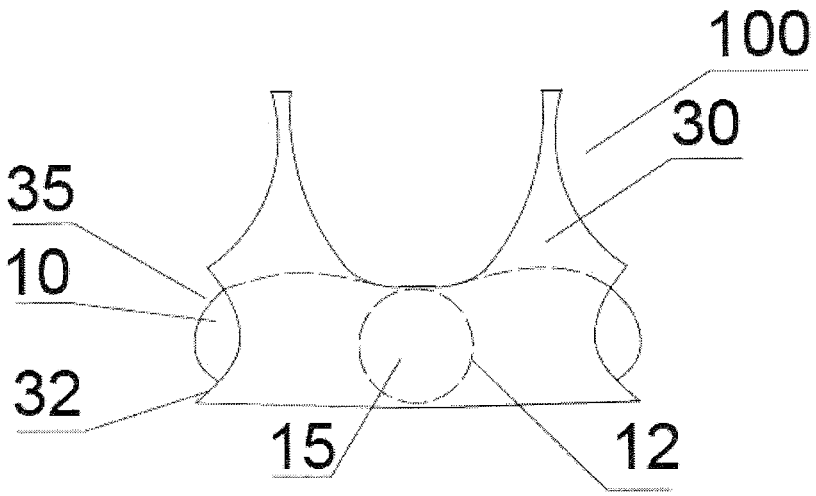
FIG. 1 is a schematic view of one embodiment of a brassiere in a non-stretched state.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

As shown in FIG. 1, in one embodiment, a brassiere 100 includes an inner layer 10 and an outer layer 30. The inner layer 10 overlaps the outer layer 30 in a non-stretched state.

In one embodiment, the inner layer 10 defines an opening 15 at a central portion and defines an inner edge 12 around the opening 15. When the brassiere 100 is dressed on, the inner layer 10 covers two nipples and majorities of two breasts. The opening 15 is located at a middle position of the two breasts. The opening 15 and inner edge 12 of the inner layer 10 are substantially circular.

In one embodiment, the outer layer 30 is located on an outer side of the inner layer 10. The outer layer 30 is partially overlapping the inner layer 10, and covers the opening 15 of the inner edge 12 in a non-stretched state. The outer layer 30 defines two lateral edges 32 on opposite sides, each lateral edge 32 defines a nook 35. Each nook 35 is substantially arcuate recessing toward the opening 15 of the inner layer 10, when the outer layer 30 is attached to the inner layer 10.

Figure 2:
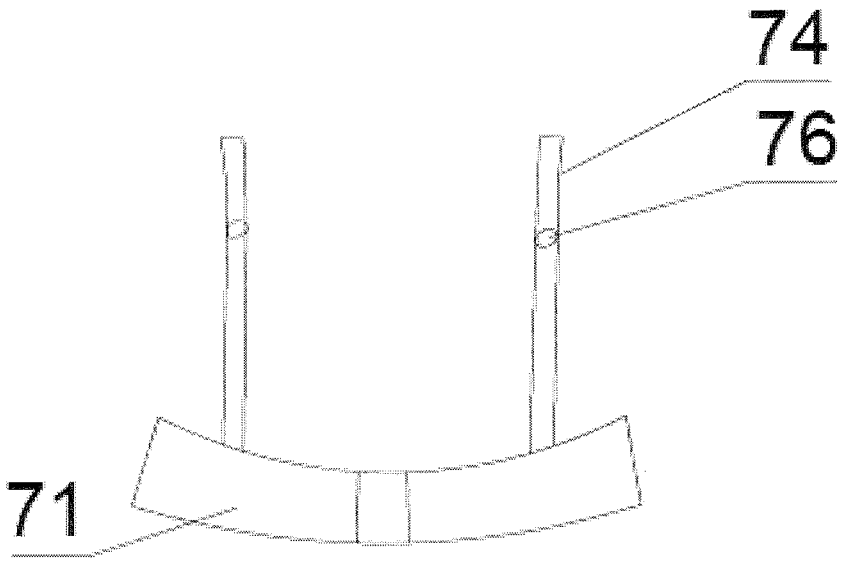
FIG. 2 is a schematic view of one embodiment of the brassiere of FIG. 1 from a rear view.
Figure 3:
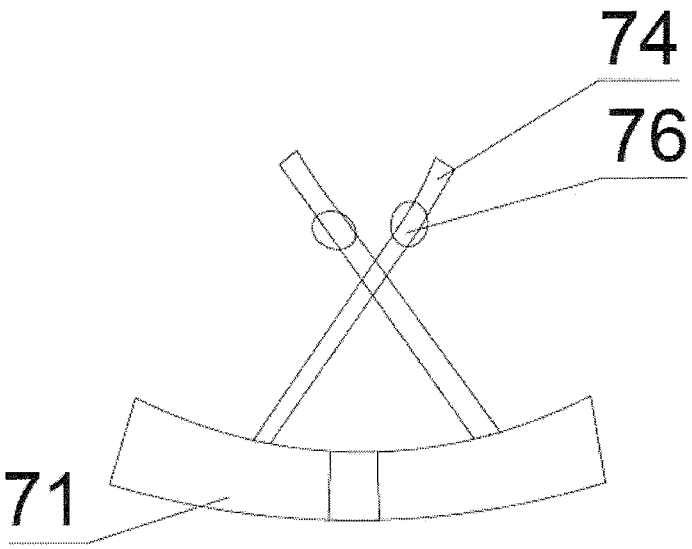
FIG. 3 is a schematic view of other embodiment of the brassiere from a rear view.
Figure 4:
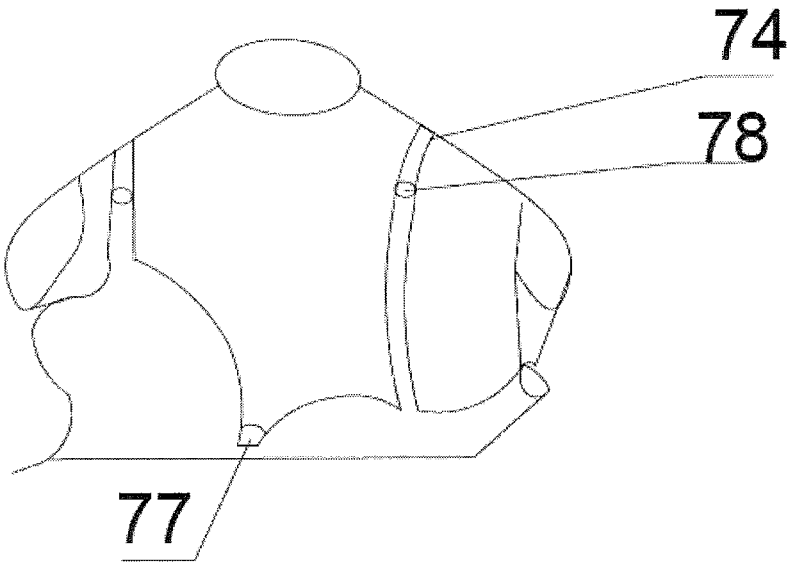
FIG. 4 is a schematic view of one embodiment of the brassiere of FIG. 1 in an uncover state for direct nursing.

As shown in FIG. 2, in one embodiment, the brassiere 100 maybe a traditional brassiere 100 having an adjustable back band 71, a pair of shoulder straps 74, and a pair of strap length adjusters 76. Each strap length adjuster 76 is allow for length adjustments to the shoulder straps 74. The pair of shoulder straps 74 connects a bottom of the inner layer 10 and the back band 71 at opposite ends. In other embodiments, as shown in FIG. 3, the pair of back bands 71 maybe cross banded. As shown in FIG. 4, the brassiere 100 further includes a releasable clasp 78 on front of each shoulder strap 74. The releasable clasp 78 connects a joint portion 77 of the outer layer 30 and the inner layer 10 to the shoulder strap 70, so that the releasable clasp 78 can disconnect the outer layer 30 and the inner layer 10 from the shoulder strap 74 to uncover the breast and the nipple for direct nursing.

Figure 5:
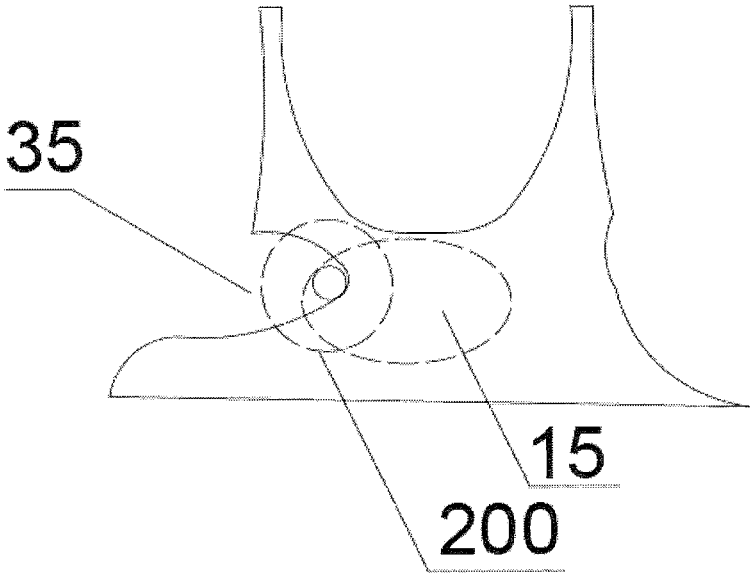
FIG. 5 is a schematic view of one embodiment of the brassiere of FIG. 1 in a stretched state.

As shown in FIG. 5, when nursing an infant, the inner layer 10 at the opening 15 is stretched lateral side to allow a funnel 200 to be inserted behind the inner layer 10. The outer layer 10 at the nook 35 is stretched inner side to allow the funnel 200 to be inserted behind the outer layer 30 within the nook 35.

When the funnel 200 is received within the brassiere 100, the funnel 200 is supported against the nipple of the breast by each of the inner edge 12 of the inner layer 10 and the lateral edge 32 of the outer layer 30. The majority of the surface of the funnel 200 is contacted and supported by the inner layer 10 and the outer layer 30, accommodating sufficient stability of the funnel 200 against the nipple. Because the inner layer 10 and the outer layer 30 are all preferably made of a uniformly stretchable material, stretching the layers to insert the funnel 200 leads to the inner edge 12 and the lateral edge 32 of the layers elastically resisting additional stretch of the edge. Accordingly, the brassiere 100 may be comfortably utilized throughout the full range of naturally-occurring nipple placements. Also, the elasticity of the material of the layers accommodates the natural expansion and contraction of a nursing woman's breasts.

In other embodiments, the outer layer 30 and the inner layer 10 are all made of a uniformly stretchable material such as spandex, or nylon.

In other embodiments, the inner layer 10 is made of a stretchable material while the outer layer 30 is not made of a stretchable material, such as a band of elastic.

In other embodiments, only one of the inner edge 12 of the inner layer 10 and the lateral edge 32 of the outer layer 30 is stretchable. Only one of the inner edge 12 of the inner layer 10 and the lateral edge 32 of the outer layer 30 is stretched away from their respective non-stretched shapes to accommodate insertion of the funnel 200 within the opening 15 and the nook 35 and underneath the inner edge 12 of the inner layer 10. Only one of the inner layer 10 and the outer layer 30 covers the nipple and a majority of the breast in the non-stretched state.

The embodiments shown and described above are only examples. Many details are often found in the art such as the other features of a system for generating picture thumbnail. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

The invention claimed is:

1. A brassiere to assist in pumping breast milk, from a female breast having a nipple, by a breast pump, comprising:

an inner layer made of stretchable material and having a circular opening defined within a central portion thereof when said inner layer is disposed in a non-stretched state and defining an inner peripheral edge portion around said circular opening; and an outer layer made of stretchable material and covering said circular opening, defined within said inner layer when said inner layer is disposed in said non-stretched state, and defining two oppositely disposed lateral edges wherein each one of said two oppositely disposed lateral edge defines a nook; and a back band connected to said outer layer;

whereby when a funnel of a breast pump is to be operatively associated with said brassiere so that milk from one breast of a female may be pumped, said inner layer of said brassiere, as worn, is stretched in a first lateral direction toward a breast to be pumped such that said circular opening is deformed so as to subsequently have a substantially elliptical configuration whereby an arcuate end portion of said inner peripheral edge portion of said substantially elliptically configured opening is moved beyond the nipple of the breast to be pumped as considered in said first lateral direction, while at the same time, the outer layer covering is moved and stretched in a second opposite lateral direction toward a breast which is not being pumped such that said nook defined within said lateral edge of said outer layer disposed adjacent to the breast to be pumped will be moved beyond the nipple of the breast to be pumped as considered in said second opposite lateral direction such that the funnel of the breast pump will effectively be entrapped between said inner edge portion of said substantially elliptical opening of said inner layer and said nook of said lateral edge of said outer layer.

2. The brassiere of claim 1, wherein the inner layer is configured to cover the nipple and a majority of the breast in the non-stretched state.

3. The brassiere of claim 2, wherein the inner edges of the inner layer are stretched in the stretched state.

4. The brassiere of claim 1, wherein the outer layer is configured to cover the nipple and a majority of the breast in the non-stretched state.

5. The brassiere of claim 4, wherein each lateral edge of the outer layer is stretched in the stretched state.

6. The brassiere of claim 1, wherein each lateral edge is substantially arcuate recessed toward the opening of the inner layer.

7. The brassiere of claim 1, wherein the brassiere further comprises a shoulder strap and a releasable clasp located on the shoulder strap, the releasable clasp is attached to a joint portion of the outer layer and the inner portion, and is configured to disconnect the outer layer and the inner layer from the shoulder strap to uncover the breast and the nipple for direct nursing.

8. The brassiere of claim 1, wherein:

said inner layer of said brassiere is configured to cover both nipples and the majorities of both breasts of a human female when said inner layer is disposed in said non-stretched state.

* * * * *